US006648615B2

(12) United States Patent
Tsai

(10) Patent No.: US 6,648,615 B2
(45) Date of Patent: Nov. 18, 2003

(54) INFLATOR

(76) Inventor: John Tsai, 27F, No. 29-3, Sec. 2, Chung-Cheng E. Rd., Tan-Shui Chen, Taipei Hsien (TW)

( * ) Notice: Subject to any disclaimer, the term of this patent is extended or adjusted under 35 U.S.C. 154(b) by 0 days.

(21) Appl. No.: 10/053,063

(22) Filed: Nov. 2, 2001

(65) Prior Publication Data

US 2003/0086802 A1 May 8, 2003

(51) Int. Cl.[7] ..... F04B 39/10; F04B 53/12
(52) U.S. Cl. ..... 417/546; 417/521
(58) Field of Search ..... 417/546, 511, 417/515, 516, 518, 521, 523, 524, 525, 526, 533; 92/23, 58.1

(56) References Cited

U.S. PATENT DOCUMENTS 5,531,575 A * 7/1996 Lin ..... 417/526
5,683,234 A * 11/1997 Chuang et al. ..... 417/531
5,702,239 A * 12/1997 Yang ..... 417/512
6,027,319 A * 2/2000 Winefordner et al. ..... 417/440
6,299,420 B1 * 10/2001 Saputo et al. ..... 417/527

* cited by examiner

*Primary Examiner*—Charles G. Freay
*Assistant Examiner*—Han L. Liu
(74) *Attorney, Agent, or Firm*—Dellett and Walters

(57) ABSTRACT

A dual-direction inflator has a tube and a cover mounted on the tube. A rod extends through the cover and is inserted in the tube. A piston is received in the tube and mounted on an end of the rod. The piston has an air-in chamber and an air-out chamber defined therein. A handle is mounted at the other end of the rod. The handle has an inlet and an outlet formed at a middle portion thereof. An inner tube is received in the rod and communicated with the inlet and with the air-in chamber. By a space defined between the inner tube and the rod, the air-out chamber is communicated with the outlet.

8 Claims, 10 Drawing Sheets

INFLATOR

BACKGROUND OF THE INVENTION

1. Field of the Invention

The present invention is related to an inflator, and more particularly to an inflator that can provide a compressed air supply whether by moving a piston downward or upward.

2. Description of Related Art

An inflator, which is used for inflating a bicycle tire, accomplishes the inflation only by pushing a rod of a piston downward. When the rod of the piston is pulled upward, the inflator cannot inflate the tire.

Now a dual-direction inflator which can inflate a tire whether by pushing a piston downward or by pulling it upward is invented.

Referring to FIGS. 9 and 10, the conventional dual-direction inflator has a tube (70) and a cover (80) mounted on a top of the tube (70). An inner tube (72) is longitudinally and eccentrically provided in the tube (70) and a first non-return valve (74), by which air in the inner tube (72) can flow out, is mounted on a top end of the inner tube (72). An orifice (76) is defined at a bottom end of the inner tube (72). By the orifice (76), the inner tube (72) is communicated with the tube (70). The cover (80) has an outlet (82) defined therethrough and a first air chamber (84) is defined in a bottom portion of the cover (80) and is communicated with the outlet (82). An aperture (86) is defined through a bottom surface of the cover (80) and aligned with the inner tube (72). The inner tube (72) is communicated with the air chamber (84) via the aperture (86), then air in the inner tube (72) can flow through the first non-return valve (74), the aperture (86) and the first air chamber (84) and out from the outlet (82). A second non-return valve (88), by which air in the tube (70) can flow in the air chamber (84), is provided at a diametrically opposite side of the aperture (86).

A rod (90) is inserted through the center of the cover (80) and has a piston (92) formed at a bottom end of thereof and received in the tube (10). The piston (92) has a passage (93) defined therethrough and the inner tube (72) is inserted through the passage (93). A second air chamber (94) is defined in the piston (92) and two third non-return valves (95, 96), by which air in the second air chamber (94) can flow in the tube (70), are respectively formed on a top and a bottom of the second air chamber (94). A handle (98) is provided at a top end of the rod (90). An inlet (99) is defined in the handle (98) and communicated with the second air chamber (94) through the rod (90).

When a user pulls the handle (98) to move the piston (92) upward, air above the piston (92) in the tube (70) flows in the first air chamber (84) through the second non-return valve (88) and then flows out through the outlet (82) for inflating a tire etc. At the same time, external air flows through the inlet (99) and the rod (90) into the second air chamber (94), and then flows through the lower third non-return valve (96) in the tube (70) beneath the piston (92).

When the user pushes the handle (98) to move the piston (92) downward, air beneath the piston (92) in the tube (70) flows sequentially through the orifice (76) in the inner tube (72), the first non-return valve (74), and the first air chamber (84), and then flows out through the outlet (99) for inflating a tire etc. At the same time, external air flows through the inlet (99) and the rod (90) into the second air chamber (94), and then flows through the upper third non-return valve (95) in the tube (70) above the piston (92).

By the rod (90) being pulled and pushed repeatedly, the inflator can quickly inflate a tire.

However, as the inner tube (72) must be inserted through the piston (92), there are two airproof points, one of which is between the tube (70) and the piston (92), the other of which is between the inner tube (72) and the passage (93). Those points make it disadvantageous to manufacture and maintain the inflator. Moreover, the handle (98) is securely mounted on the rod (90) and the piston (92) also cannot be turned in the tube (70), so that the handle (98) cannot be turned about the tube (70). If a user carelessly turns the handle (70), the piston (92) or the inner tube (72) may be destroyed. A further problem is that using the dual-direction inflator requires more energy to be input by a user and such effort may be beyond what a child etc can provide. Thus, the limitation of being usable only as a dual-direction inflator is inconvenient and may render the inflator useless.

Therefore, the invention provides an improved dual-direction inflator to mitigate and/or obviate the aforementioned problems.

SUMMARY OF THE INVENTION

The main objective of the invention is to provide an inflator of which a handle can be freely turned about a tube.

Another objective of the invention is to provide an inflator which can be configured to expel compressed air when a piston is either moved downward or downward and upward.

Other objects, advantages and novel features of the invention will become more apparent from the following detailed description when taken in conjunction with the accompanying drawings.

DETAILED DESCRIPTION OF THE PREFERRED EMBODIMENT

Figure 1:
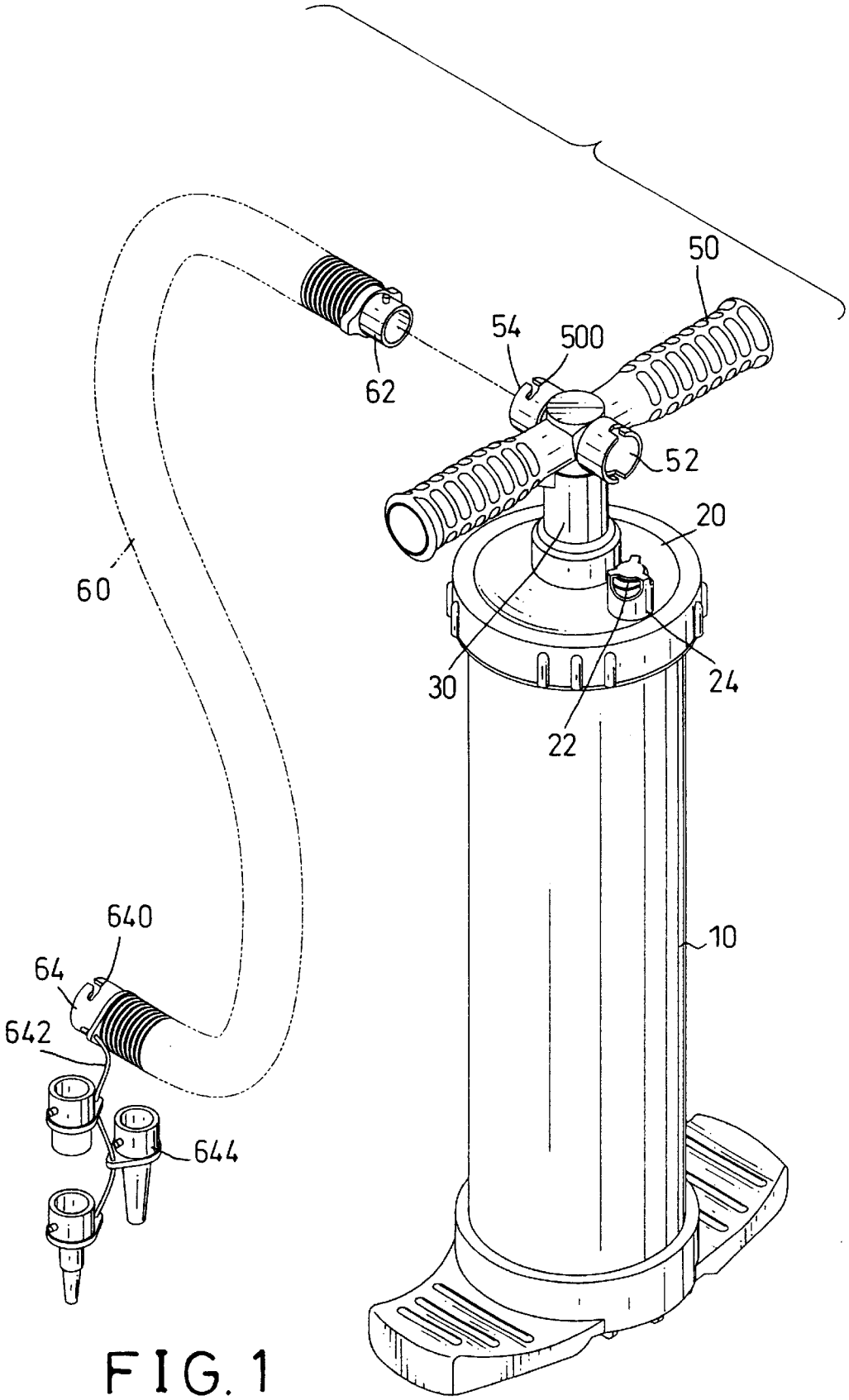
FIG. 1 is a perspective view of a dual-direction inflator in accordance with the invention.
Figure 2:
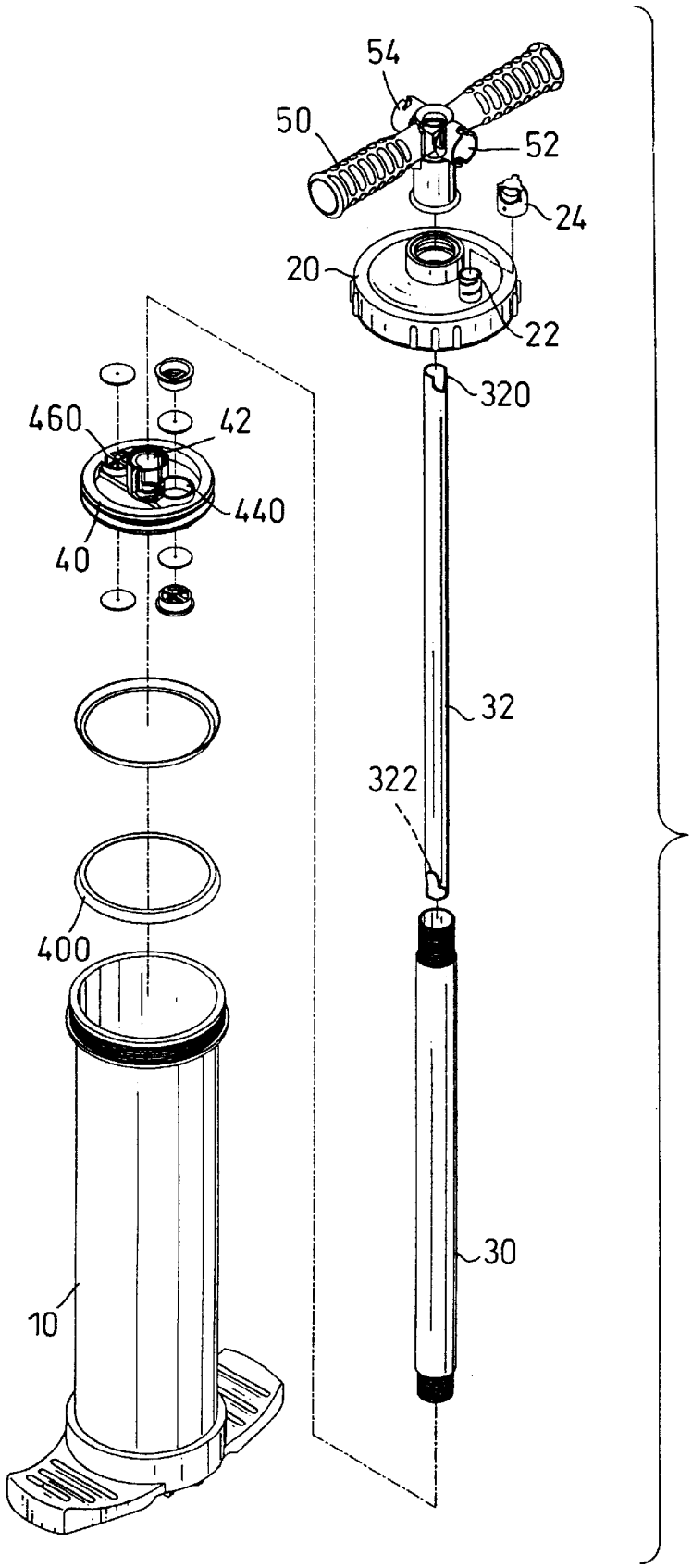
FIG. 2 is an exploded perspective view of the dual-direction inflator in accordance with the invention.

Referring to FIGS. 1 and 2, a dual-direction inflator in accordance with the present invention has a tube (10) and a cover (20) mounted on a top of the tube (10). A rod (30) extends through the cover (20) and is inserted in the tube (10). A piston (40) is provided at a bottom end of the rod (30) and a handle (50) is provided at a top end of the rod (30).

The handle (50) has an inlet (52) and an outlet (54) oppositely formed at a middle portion of the handle (50). The inlet (52) and the outlet (54) each have an L-shaped notch (500) defined at an outer edge thereof. A hose (60) has a first joint (62) engaged with the outlet (54). The first joint (62) has a lug (not numbered) formed on an outer periphery thereof and positioned in the L-shaped notch (500) to securely engage the hose (60) to the outlet (54). A second joint (64) is formed at the other end of the hose (60) and also has an L-shaped notch (640) defined at an outer edge thereof. Various air nozzles (644) are provided at the second joint (64) by a cord (642) and can be selectively mounted on the second joint (64). A vent (22) is defined through the cover (20) and beside the rod (30), and is closed by a vent cap (24) provided thereon.

Figure 3:
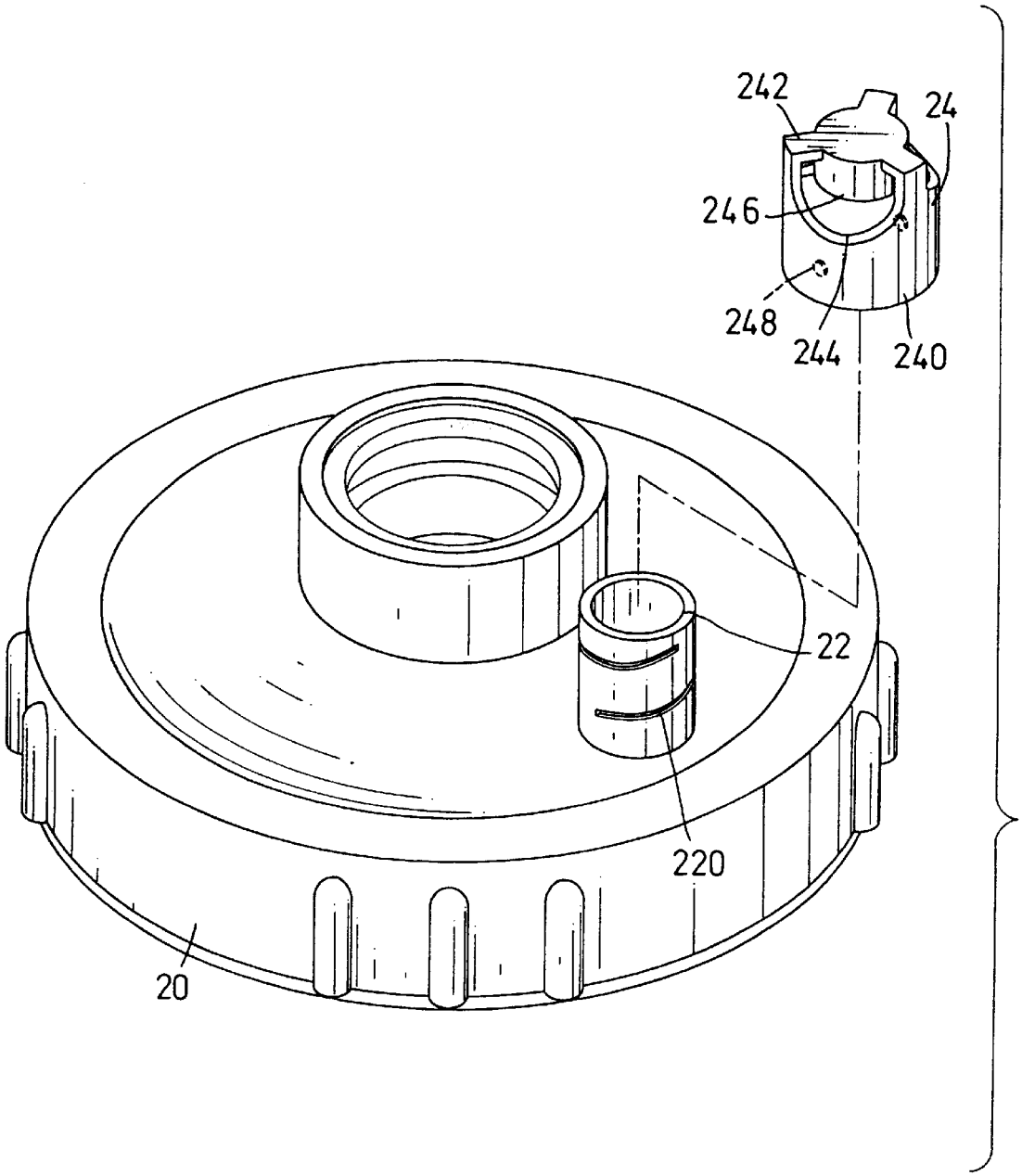
FIG. 3 is an exploded perspective view of a cover of the dual-direction inflator.

With reference to FIG. 3, the vent (22) has a tubular body (not numbered) and a threaded slot (220) defined on an outer periphery of the tubular body. The vent cap (24) has an open lower end (240). A plurality of bridges (242) are radially formed at a top end of the vent cap (24) and a plurality of notches (244) is respectively defined between the bridges (242). A plug (246) is formed at the center of the top end and connected to a body of the vent cap (24) by the bridges (242). A pin (248) is formed on an inner wall of the vent cap (24) and engaged in the threaded slot (220) to mount the vent cap (24) on the vent (22). When the vent cap (24) is turned downwards, the plug (246) is inserted in the vent (22) to close the vent (22).

Figure 4:
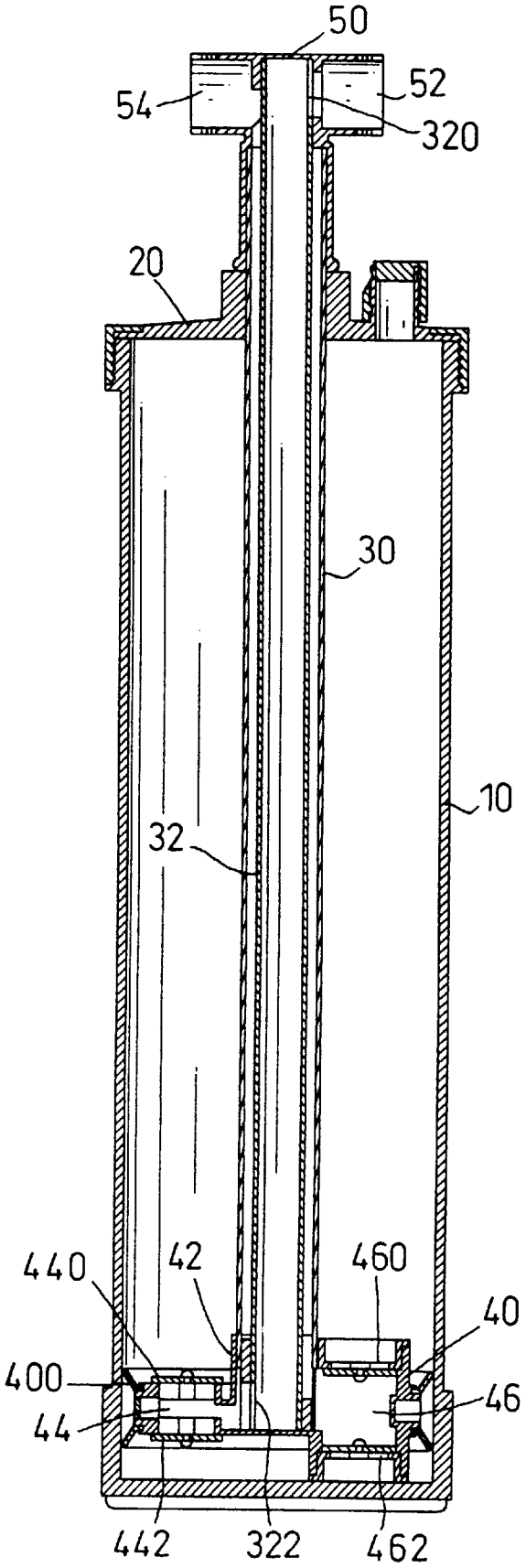
FIG. 4 is a cross sectional view of the dual-direction inflator.

With reference to FIGS. 2 and 4, the piston (40) is received in the tube (10) and at least one airproof washer (400) is assembled on an outer periphery of the piston (40). A sleeve (42) is formed at the center of the piston (40). An air-in chamber (44) and an air-out chamber (46) are defined in the piston (40). Two first non-return valves (440, 442), by which air can enter the air-in chamber (44), are provided in the air-in chamber (44) and respectively at a top and a bottom of the piston (40). Two second non-return valves (460, 462), by which air can exit out the air-out chamber (46), are provided in the air-out chamber (46) and respectively at the top and the bottom of the piston (40).

The bottom end of the rod (30) is mounted in the sleeve (42) and the top end of the rod (30) is mounted in the handle (50). An inner tube (32) is received in the rod (30) and has an upper notch (320) and a lower notch (322) respectively defined at a top and a bottom thereof. The upper notch (320) is in communication with the inlet (52) and the lower notch (322) is in communication with the air-in chamber (44). A space between the inner tube (32) and the rod (30) is respectively communicated with the outlet (54) and the air-out chamber (46). Thus, air in the air-out chamber (46) can flow out from the outlet (54) through the space between the inner tube (32) and the rod (30).

The piston (40) can be moved upward or downward in the tube (10) by the handle (50) provided on the rod (30). External air flows in the air-in chamber (44) through the inlet (52) and the inner tube (32), and through one of the first non-return valves (440, 442) into the tube (10). The air in the tube (10) then flows in the air-out chamber (46) through one of the second non-return valves (460, 462), and out from the outlet (54) through the space between the inner tube (32) and the rod (30).

Figure 5:
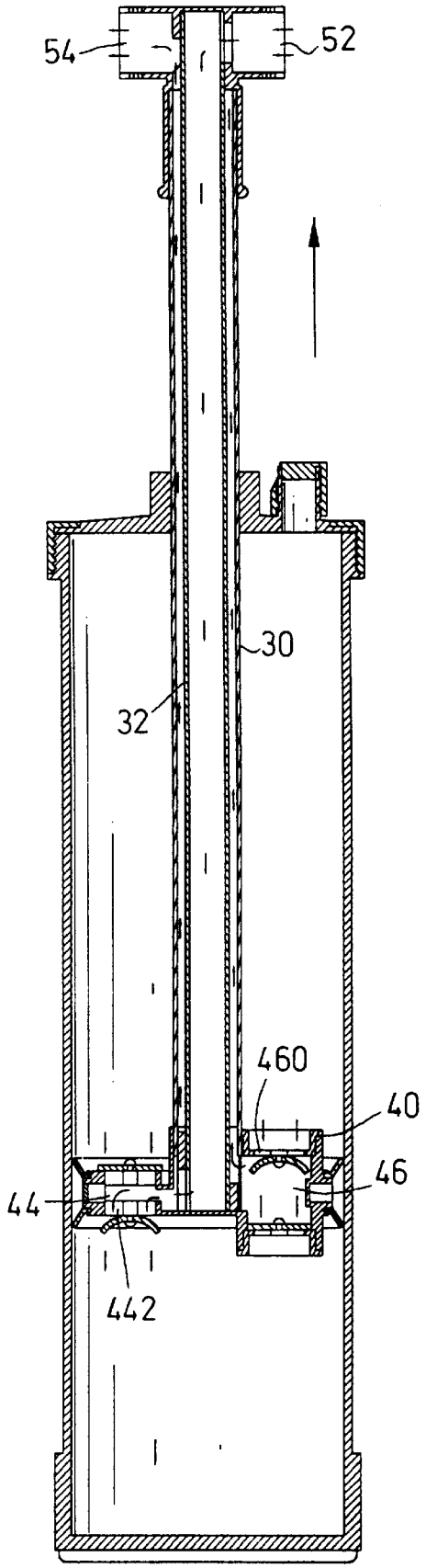
FIG. 5 is a cross sectional view showing a status of the dual-direction inflator when a piston is pulled up.

With reference to FIG. 5, when the piston (40) is pulled upward, air above the piston (40) in the tube (10) flows in the air-out chamber (46) through the upper second non-return valve (460), and flows out the outlet (54) through the space between the inner tube (32) and the rod (30). At the same time, external air flows in the air-in chamber (44) through the inlet (52) and the inner tube (32), and flows in the tube (10) and beneath the piston (40) through the lower first non-return valve (442).

Figure 6:
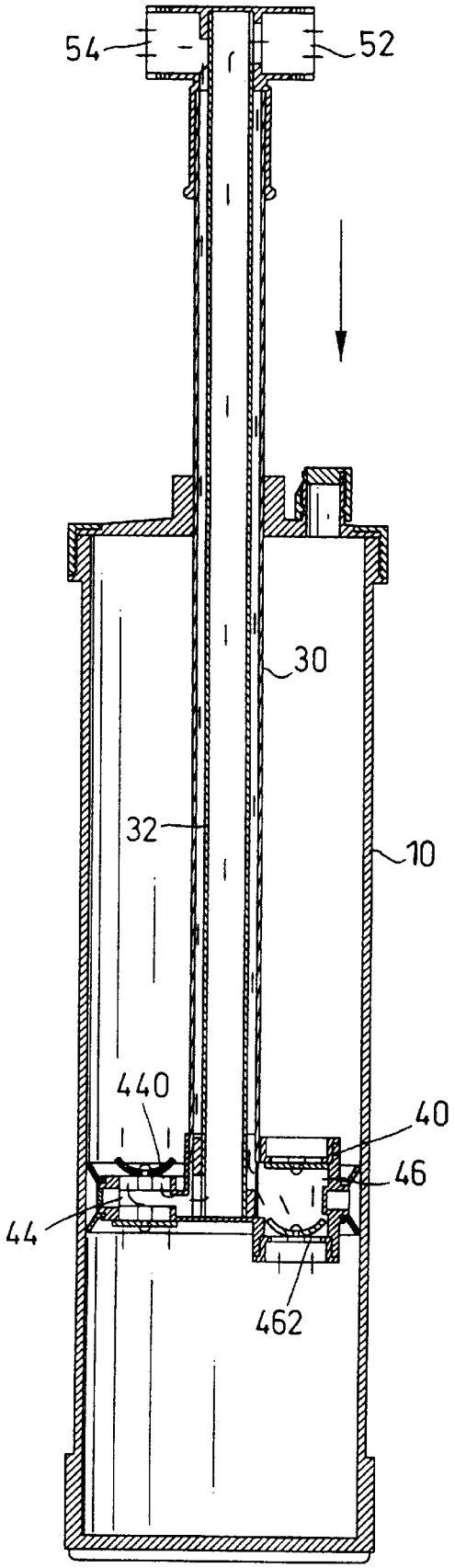
FIG. 6 is a cross sectional view showing a status of the dual-direction inflator when a piston is pushed down.

With reference to FIG. 6, when the piston (40) is pushed downward, air beneath the piston (40) in the tube (10) flows in the air-out chamber (46) through the lower second non-return valve (462), and flows out the outlet (54) through the space between the inner tube (32) and the rod (30). At the same time, external air flows in the air-in chamber (44) through the inlet (52) and the inner tube (32), and flows in the tube (10) and above the piston (40) through the upper first non-return valve (440).

Therefore, the inflator can expel air whether the rod (30) is pushed downward or pulled upward.

Figure 7:
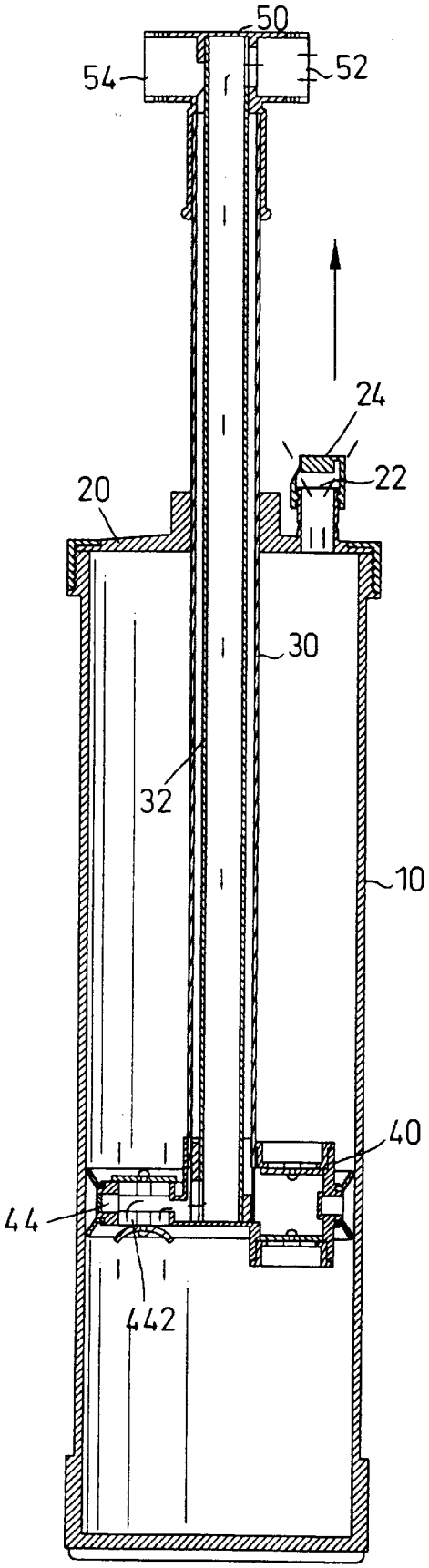
FIG. 7 is a cross sectional view showing a status of the dual-direction inflator when a piston is pulled up and a vent is opened.
Figure 8:
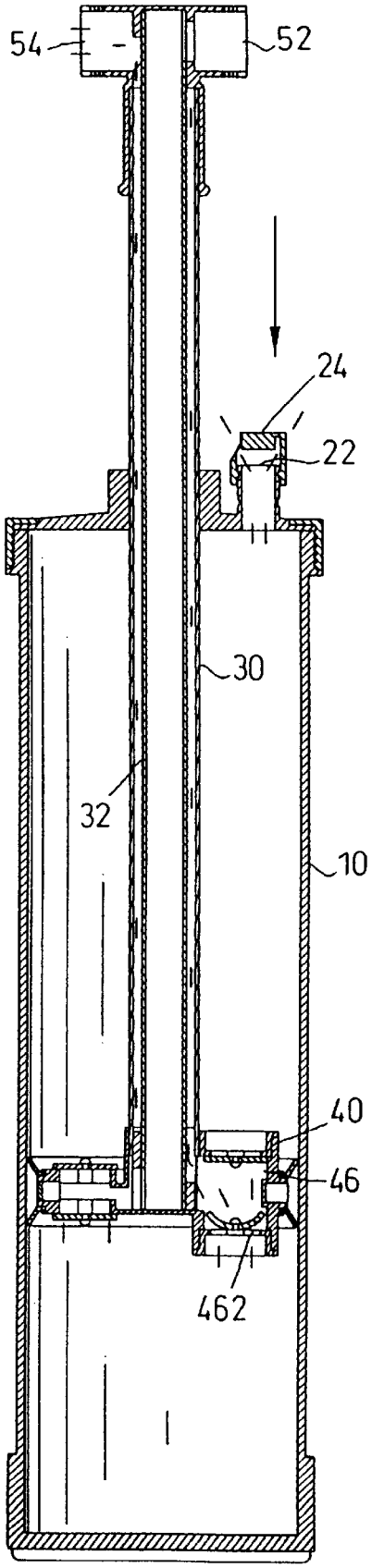
FIG. 8 is a cross sectional view showing a status of the dual-direction inflator when a piston is pushed down and the vent is opened.
Figure 9:
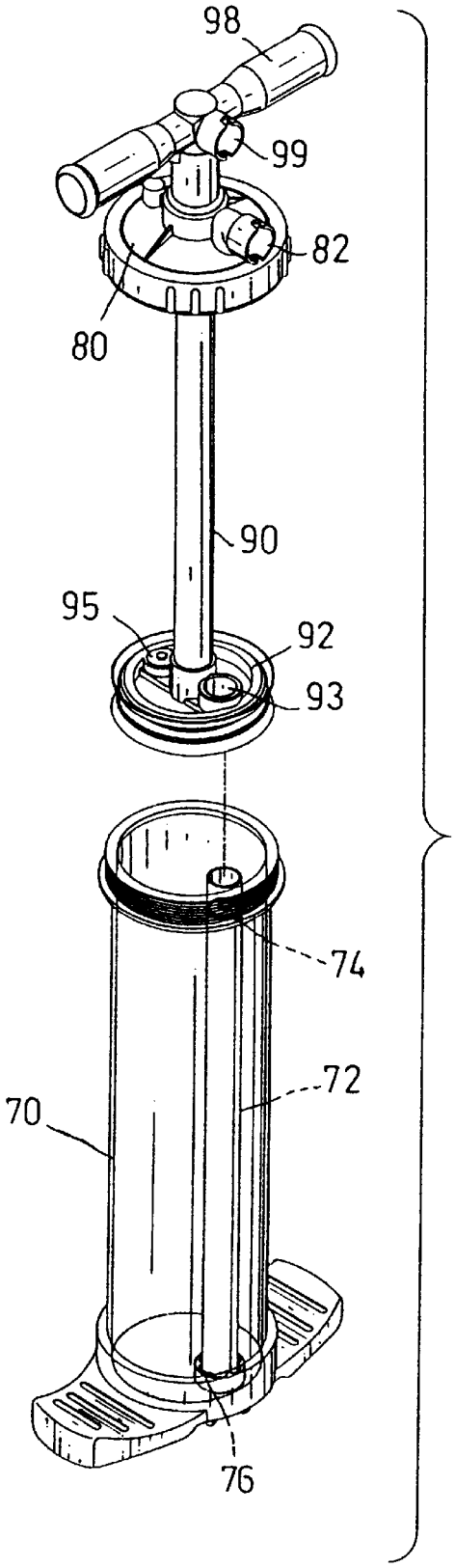
FIG.9 PRIOR ART
FIG. 9 is an exploded perspective view of a conventional dual-direction inflator.
Figure 10:
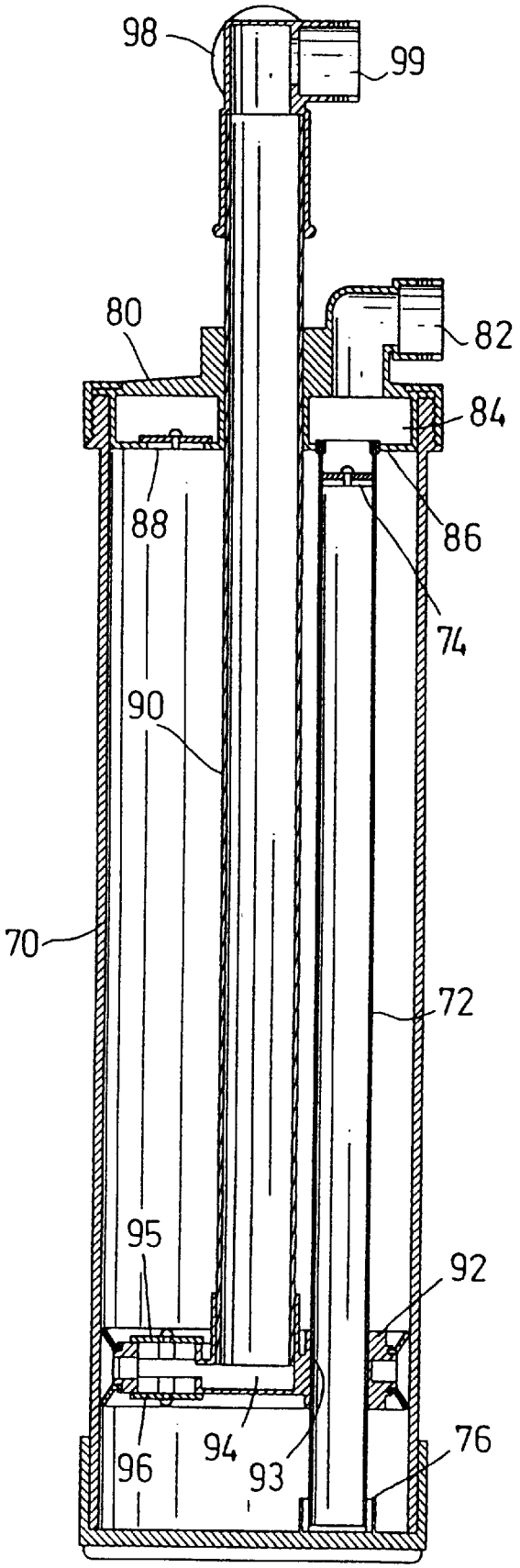
FIG.10 PRIOR ART
FIG. 10 is a cross sectional view of the conventional dual-direction inflator.

With reference to FIGS. 7 and 8, when the vent cap (24) is removed to open the vent (22), the inflator can expel air only by the rod (30) being pushed downward. When the rod (30) is pulled upward as shown in FIG. 7, air above the piston (40) in the tube (10) flows out from the vent (22) and will not flow in the air-out chamber (46). At the same time, external air flows in the air-in chamber (44) through the inlet (52) and the inner tube (32), and flows in the tube (10) and beneath the piston (40) through the lower first non-return valve (442). When the rod (30) is pushed downwards as shown in FIG. 8, air beneath the piston (40) in the tube (10) flows in the air-out chamber (46) through a lower second non-return valve (462), and flows out the outlet (54) through the space between the inner tube (32) and the rod (30). At the same time, external air flows in the tube (10) and above the piston (40) through the vent (22).

From the above description, it is noted that the invention has the following advantages:

1. Because the piston (40) is able to be turned in the tube (10), the user can freely turn the handle (50).

2. When the user is a child or a person who does not have enough strength to pull up the rod (30) when the inflator is in the dual-direction mode, he or she can open the vent (22). Therefore, the user can easily pull up the rod (30) and can put his or her weight on the rod (30) to push down the rod to inflate.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An inflator comprising:

a tube (10);

a cover (20) mounted on a top of said tube (10);

a rod (30) extending through said cover (20) and inserted in said tube (10);

a piston (40) received in said tube (10) and mounted on a bottom end of said rod (30), said piston (40) having an air-in chamber (44) and an air-out chamber (46) defined therein, two first non-return valves (440, 442), by which air can flow in said tube (10) from said air-in chamber (44), respectively provided at a top and a bottom of said air-in chamber (44), and two second non-return valves (460, 462), by which air can flow in said air-out chamber (46) from said tube (10), respectively provided at a top and a bottom of said air-out chamber (46);

a handle (50) mounted at a top end of said rod (30), said handle (50) having an inlet (52) and an outlet (54) oppositely formed at a middle portion thereof;

an inner tube (32) received in said rod (30), said inner tube (32) having an upper notch (320) defined at a top end thereof and communicated with said inlet (52), and a lower notch (322) defined at a bottom end thereof and communicated with said air-in chamber (44); and a space defined between said inner tube (32) and said rod (30), said space being in communication with said air-out chamber (46) and said outlet (54).

2. The inflator as claimed in claim 1, wherein said cover (20) has a vent (22) defined therethrough and beside said rod (30), and a vent cap (24) is provided on said vent (22) to close the vent (22).

3. The inflator as claimed in claim 2, wherein said vent (22) has a tubular body and a threaded slot (220) defined on an outer periphery of the tubular body.

4. The inflator as claimed in claim 2, wherein said vent cap (24) has an open lower end (240), a plurality of bridges (242) radially formed at a top end thereof, a plurality of notches (244) respectively defined between said bridges (242), and a plug (246), which can inserted in the said vent (22), formed at the center of the top end and connected with the bridges (242).

5. The inflator as claimed in claim 4, wherein said vent cap (24) has a pin (248) formed on an inner wall thereof and engaged with said threaded slot (220).

6. The inflator as claimed in claim 1, wherein said inlet (52) and said outlet (54) each have an L-shaped notch (500) defined at an outer edge thereof.

7. The inflator as claimed in claim 1, wherein said piston (40) has a sleeve (42) formed at the center of a top face thereof, and the bottom end of said rod (30) is mounted in said sleeve (42).

8. The inflator as claimed in claim 1, wherein said piston (40) has at least one airproof washer (400) provided on an outer periphery thereof.

* * * * *